US007703549B2

(12) United States Patent
Krepp et al.

(10) Patent No.: US 7,703,549 B2
(45) Date of Patent: Apr. 27, 2010

(54) METHOD AND APPARATUS FOR REMOVING CUTTINGS IN HIGH-ANGLE WELLS

(75) Inventors: Anthony N. Krepp, The Woodlands, TX (US); Michael G. Mims, Conroe, TX (US); Brandon M. Foster, The Woodlands, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/415,643

(22) Filed: May 2, 2006

(65) Prior Publication Data

US 2006/0243491 A1 Nov. 2, 2006

Related U.S. Application Data

(60) Provisional application No. 60/676,777, filed on May 2, 2005.

(51) Int. Cl.
*E21B 7/04* (2006.01)
*E21B 17/00* (2006.01)

(52) U.S. Cl. ..... 175/61; 175/320; 175/324; 175/62; 175/65

(58) Field of Classification Search ..... 175/320, 175/324, 61, 62
See application file for complete search history.

(56) References Cited

U.S. PATENT DOCUMENTS

| | | | | |
|---|---|---|---|---|
| 2,498,192 | A | 2/1950 | Wright | |
| 2,956,781 | A | 10/1960 | Eastman | |
| 3,369,617 | A | 2/1968 | Brack et al. | |
| 4,361,193 | A * | 11/1982 | Gravley | 175/61 |
| 4,428,441 | A * | 1/1984 | Dellinger | 175/61 |
| 4,465,146 | A * | 8/1984 | Fitch | 175/61 |
| 4,754,819 | A | 7/1988 | Dellinger | |
| 4,811,800 | A | 3/1989 | Hill et al. | |
| 5,040,620 | A * | 8/1991 | Nunley | 175/61 |
| 5,148,877 | A | 9/1992 | MacGregor | |
| 5,327,984 | A | 7/1994 | Rasi et al. | |
| 5,375,669 | A | 12/1994 | Cherrington | |

(Continued)

OTHER PUBLICATIONS

R. Allen Shook, James A. Dech, William C. Maurer, Ron P. Matson, Dan T. Mueller, Mark Hopmann, Paul Boonen, Scott R. Reeves "Slim-Hole Drilling and completion barriers Final Report" Gas Research Institute, May 1995, GRI-95/0182 contract No. 5093-222-2603, p. 51.*

(Continued)

*Primary Examiner*—David J. Bagnell
*Assistant Examiner*—Cathleen R Hutchins
(74) *Attorney, Agent, or Firm*—Brigitte L. Echols; Henry L. "Bud" Ehrlich

(57) ABSTRACT

A method of removing cuttings includes the steps of disposing a pipe string in a high-angle wellbore, circulating mud through the wellbore and creating a viscous coupling layer of mud spiraling about a section of the pipe string. Wherein the wellbore may be deviated from vertical thirty degrees or greater. The viscous coupling layer desirably extends outwardly beyond the outside diameter of the tooljoint upsets in the section of the pipe string. A pipe joint for creating a viscous coupling layer of drilling fluid spiraling about the pipe to remove cuttings from high angle wells includes an elongated tubular having an outer surface extending between opposing tooljoints, tooljoint upsets and projections provided on substantially the entire outer surface.

15 Claims, 2 Drawing Sheets

U.S. PATENT DOCUMENTS

| | | | | |
|---|---|---|---|---|
| 5,651,420 | A * | 7/1997 | Tibbitts et al. | 175/102 |
| 5,984,001 | A | 11/1999 | Welkey | |
| 5,984,011 | A | 11/1999 | Misselbrook et al. | |
| 6,386,299 | B1 | 5/2002 | Kato | |
| 6,397,957 | B2 * | 6/2002 | Mocivnik et al. | 175/320 |
| 6,840,337 | B2 * | 1/2005 | Terry et al. | 175/38 |
| 7,040,422 | B2 * | 5/2006 | Springer | 175/323 |
| 2002/0046882 | A1 * | 4/2002 | Smith | 175/19 |
| 2003/0131992 | A1 | 7/2003 | Michael et al. | |
| 2004/0079553 | A1 | 4/2004 | Livingstone | |
| 2004/0195007 | A1 | 10/2004 | Eppink | |

OTHER PUBLICATIONS

International Search Report, dated Aug. 14, 2007 (PCT/US2006/042117).

* cited by examiner

METHOD AND APPARATUS FOR REMOVING CUTTINGS IN HIGH-ANGLE WELLS

RELATED APPLICATIONS

This application claims the benefit of U.S. Provisional Patent Application No. 60/676,777 filed on May 2, 2005.

FIELD OF THE INVENTION

The present invention relates in general to cutting removal in wellbores and more specifically to methods and apparatus for removing cuttings in high-angle wellbores.

BACKGROUND

During drilling operations and the like, drilling fluid or mud is circulated down through the drill string, out the bottom of the pipe string and back to the surface through the wellbore. Among its other purposes, the drilling mud removes cuttings and debris from the wellbore. In high-angle wellbores, the gravity vector is substantially vertical and the velocity vector of the mud deviates from vertical and may be horizontal or substantially horizontal in sections of the wellbore. Thus, the cuttings tend to settle to the low side of the wellbore and form cutting beds. Attempts to improve cutting removal have included increasing rotational speed of the pipe, increasing the flowrate of the mud and altering mud rheology with little effect. Additionally, wellbore conditions and/or rig limitations limit these options.

Therefore, it is a desire to provide a system and method for improving cutting removal in high-angle wellbores.

SUMMARY OF THE INVENTION

Accordingly, apparatus and methods for removing cuttings from high-angle wellbores are provided. In one embodiment, a method of removing cuttings includes the steps of disposing a pipe string in a high-angle wellbore, circulating mud through the wellbore and creating a viscous coupling layer of mud spiraling about a section of the pipe string. Wherein the wellbore may be deviated from vertical thirty degrees or greater. The viscous coupling layer desirably extends outwardly beyond the outside diameter of the tooljoint upsets in the section of the pipe string.

In some embodiments, a pipe to create a spiraling viscous coupling layer of drilling mud about the pipe when it is rotated for removing cuttings in high-angle wellbores includes an elongated tubular having an outer surface extending between opposing tooljoints, tooljoint upsets and projections provided on substantially the entire outer surface.

Desirably the projections form a roughness selected to create the viscous coupling layer of a depth greater than the tooljoint upset. The roughness may be selected based on wellbore diameter, pipe diameter, pipe rotational speed, or mud rheology singularly or in combination to create a viscous coupling layer extending beyond the depth of the tooljoint upset.

The foregoing has outlined the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
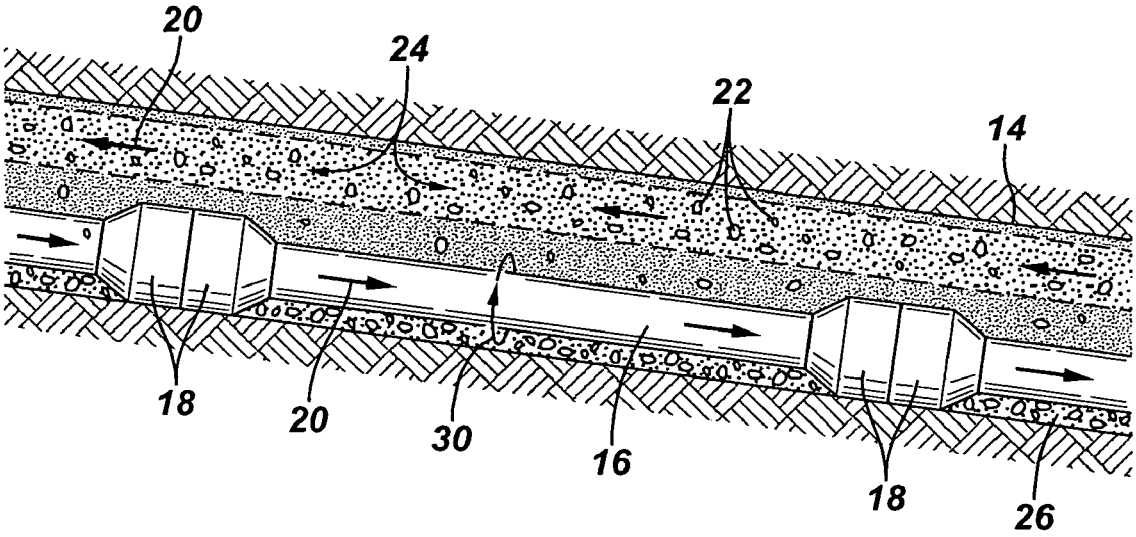
FIG. 1 is a schematic of a high-angle wellbore illustrating cutting removal.

Refer now to the drawings wherein depicted elements are not necessarily shown to scale and wherein like or similar elements are designated by the same reference numeral through the several views.

As used herein, the terms "up" and "down"; "upper" and "lower"; and other like terms indicating relative positions to a given point or element are utilized to more clearly describe some elements of the embodiments of the invention. Commonly, these terms relate to a reference point as the surface from which drilling operations are initiated as being the top point and the total depth of the well being the lowest point.

FIG. 1 is a perspective view of a high-angle wellbore 12 illustrating the removal of cuttings from the wellbore. High-angle wellbores are described herein as wellbores that are deviated from vertical approximately thirty degrees or greater, and in particular to wellbores that deviate from vertical approximately sixty-five degrees or greater. Wellbore 12 may be an open hole having a wall 14 formed by the surrounding formation or wall 14 may be formed at least in part by casing.

A pipe string comprised of a plurality of pipe joints 16 is disposed in wellbore 12 for conducting drilling operations. Each joint 16 includes a tooljoint 18 for connecting to adjacent pipe joints 16. Drilling fluid or mud 20 is pumped down the pipe string out the end and is circulated back to the surface through the wellbore-pipe string annulus as illustrated by the arrows. Among the purposes of utilizing mud 20 is to remove the cuttings 22 from wellbore 12.

In high-angle wells, drill pipe 16 tends to settle on the low side of wellbore 12 and drilling mud 20 flows through the high side of wellbore 12. It has been noted that in laminar flow conditions, drilling mud 20 forms a flow channel 24 identified by the dashed lines. Drilling mud 10 tends to flow at a higher velocity through flow channel 24 as opposed to other regions of wellbore 12. As cuttings 22 are carried up wellbore 12 by mud 20, gravity causes cuttings 22 to drop to the low side of wellbore 12, often forming a cutting bed 26. As the depth of cutting bed 26 increases the effective diameter of wellbore 12 decreases and pipe sticking occurs.

Figure 2:
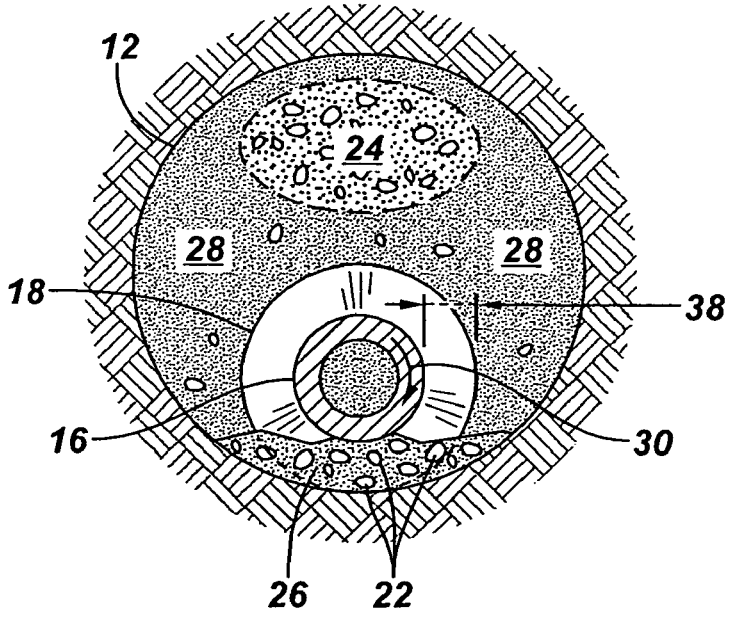
FIG. 2 is an end view of the high-angle wellbore of FIG. 1.

Referring now to FIG. 2, an end view of wellbore 12 of FIG. 1 is illustrated. In laminar flow conditions, flow channel 24 of mud 20 forms proximate the high side of wellbore 12. The region of wellbore 12 between flow channel 24 and cutting bed 26 is referred to herein as the dead zone 28. Cuttings 22 in dead zone 28 settle to the low side of wellbore 12 and form cutting bed 26 as opposed to being transported up wellbore 12.

Increasing the flow rate of the drilling mud will increase the size of fluid channel 24 until an equilibrium position, in which additional increase in the mud flow rate appears to not provide any benefit. By rotating pipe 16 as shown by the arrow 30 some benefits have been shown in cutting 22 removal. However, it has been noted that increased rotational speed of pipe 16 does not adequately clean wellbore 12 and in exceptionally high-angle wells increased rotational speed does not alleviate cutting bed 26 formation. Additionally, in many situations high rotational speed is not an option due to rig limitations or due to the resultant increase in the equivalent circulating density from the increased rotational speed.

Figure 3:
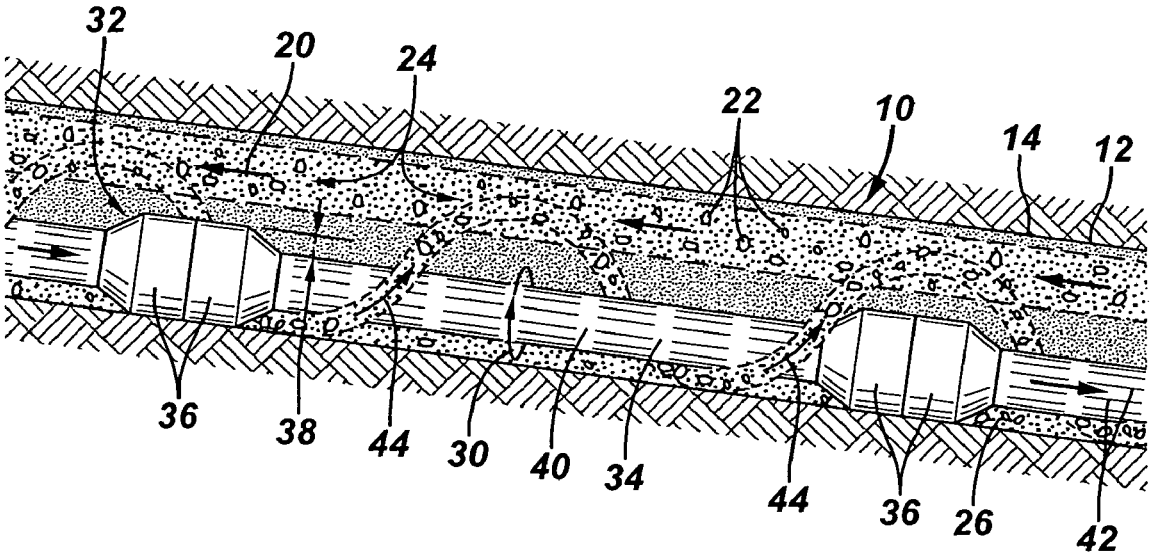
FIG. 3 is a side view of a high-angle wellbore wherein cuttings are removed from the wellbore utilizing an embodiment of the present invention.

Referring now to FIG. 3, an embodiment of a cutting removal system and method, generally denoted by the numeral 10, of the present invention is illustrated. Cutting removal system 10 includes a pipe string 32 comprising a plurality of interconnected pipe joints 34 having tooljoints 36 at each end. Each joint 34 has a tooljoint upset 38, which is the distance between the outside diameter of tooljoint 36 and the outside diameter of joint 34.

In one embodiment of the present invention, cutting removal joint 34 includes a roughened or textured surface 40 extending substantially between its opposing tooljoints 36. Pipe 34 includes projections 42 to create roughened surface 40. Projections 42 may formed on pipe 34 during manufacture or by coating or machining surface 40. Projections 42 may include, without limitation, ridges, serrations or particulate. When pipe string 32 is rotated, shown by the arrow 30, roughened surface 40 creates a spiraling viscous coupling layer 44 about it.

Viscous coupling layer 44 has a width greater than tooljoint upset 38 and thus extends beyond the outside diameter of tooljoints 36. Viscous coupling layer 44 spirals about pipe string 32 carrying cuttings 22 into flow channel 24 for removal from wellbore 12. It is noted that the degree of roughness or texture of surface 40 may be varied to adapt to wellbore 12 characteristics such as, but not limited to, drilling mud 20 rheology, mud flow rate, wellbore 12 diameter and pipe 34 diameter.

It is noted that cutting removal pipe 34 of the present invention creates the viscous coupling layer 44 along its length, thus cuttings 22 are continuously circulated into flow channel 24 for transport. In some prior art cutting removal systems it is believed that cuttings may be thrown into flow channel 24 proximate the tooljoints. However, the cuttings often then drop back to the low side of the hole between the tooljoints. As such, cutting bed 26 continues to build in the wellbore between the tooljoints.

In other embodiments of the present invention, tooljoint upset 38 may be reduced relative to conventional drillpipe. In still further embodiments, the profile of tooljoints 36 may be modified, such as by tapering down to surface 40 of joints 36. The reduced tooljoint upset 38 or tapered profile further facilitate extending viscous coupling layer 44 beyond the outside diameter of tooljoints 36.

From the foregoing detailed description of specific embodiments of the invention, it should be apparent that a system and method for removing cuttings in high-angle wells that is novel has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A pipe to create a spiraling viscous coupling layer of drilling mud about the pipe when the pipe is rotated for removing cuttings in high-angle wellbores, the pipe comprising:

an elongated tubular having an outer surface extending between opposing tooljoints, the tooljoints having an outside diameter greater than an outside diameter of the outer surface; and particulate disposed on substantially the entire outer surface to form a selected roughness to create the spiraling viscouc coupling layer extending from the surface beyond the outside diameter of the tooljoints.

2. The pipe of claim 1, wherein the selected roughness is for a selected tubular rotation speed and wellbore diameter.

3. The pipe of claim 1, wherein the selected roughness is for a selected diameter of the tubular and wellbore diameter.

4. The pipe of claim 1, wherein the selected roughness is for a selected tubular diameter, wellbore diameter and tubular rotation speed.

5. The pipe of claim 1, wherein the selected roughness is for a selected tubular diameter, wellbore diameter, mud rheology and tubular rotation speed.

6. A method of removing cuttings from a high-angle wellbore, the method comprising the steps of:

providing a pipe joint having an outer surface extending between opposing tooljoints, the tooljoints having an outer diameter greater than an outer diameter of the outer surface;

creating a selected roughness on the outer surface comprising particulate;

connecting the pipe joint in a section of a pipe string;

disposing the section of the pipe string in a high-angle wellbore;

circulating mud through the wellbore, wherein the selected roughness creates a spiraling viscous coupling layer of mud that extends from the outer surface beyond the outer diameter of the tool joint upsets.

7. The method of claim 6, wherein the wellbore is deviated from vertical thirty degrees or greater.

8. The method of claim 6, wherein the wellbore is deviated from vertical sixty-five degrees or greater.

9. The method of claim 6, wherein the step of creating a selected roughness is based on a selected pipe string rotation speed and wellbore diameter.

10. The method of claim 6, wherein the step of creating a selected roughness is based on a selected pipe string diameter and wellbore diameter.

11. The method of claim 6, wherein the step of creating a selected roughness is based on a selected pipe string diameter, welibore diameter and pipe string rotation speed.

12. The method of claim 6, wherein creating a selected roughness comprises coating the outer surface with the particulate.

13. The method of claim 12 wherein the step of creating a selected roughness is based on a selected pipe string rotation speed and wellbore diameter.

14. The method of claim 12, wherein the step of creating a selected roughness is based on a selected pipe string diameter and wellbore diameter.

15. The method of claim 12, wherein the step of creating a selected roughness is based on a selected pipe string diameter, wellbore diameter and pipe string rotation speed.

* * * * *